US007815470B2

(12) United States Patent
Ho

(10) Patent No.: US 7,815,470 B2
(45) Date of Patent: Oct. 19, 2010

(54) SHIELDING SHELL OF CONNECTOR

(75) Inventor: Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 195 days.

(21) Appl. No.: 12/285,842

(22) Filed: Oct. 15, 2008

(65) Prior Publication Data

US 2010/0093212 A1 Apr. 15, 2010

(51) Int. Cl.
*H01R 9/03* (2006.01)

(52) U.S. Cl. ..... 439/607.48; 439/607.54

(58) Field of Classification Search ..... 439/607.01, 439/607.37, 607.48, 607.54, 607.47, 607.56, 439/607.57, 660, 731
See application file for complete search history.

(56) References Cited

U.S. PATENT DOCUMENTS 7,198,522 B1 * 4/2007 Ho et al. ..... 439/660

* cited by examiner

*Primary Examiner*—Javaid Nasri
(74) *Attorney, Agent, or Firm*—Rosenberg, Klein & Lee

(57) ABSTRACT

A shielding shell includes an upper shell and a lower shell. The upper shell has a rear cover engaged in the lower shell, and a front cover connected to a front of the rear cover and mounted beyond the lower shell. The lower shell has a base board, two side boards protruding upward from two opposite sides of a rear of the base board, and a front board protruding upward from a front end of the base board. Two opposite ends of the front board extend sideward to form a pair of fixing boards bent rearward to lie substantially in alignment with the corresponding side boards. Wherein a free end of each of the fixing boards extends to form a fixing portion buckled into a corresponding fixing cavity defined in a front of each of the side boards for fixing the fixing board to the corresponding side board.

3 Claims, 2 Drawing Sheets

SHIELDING SHELL OF CONNECTOR

BACKGROUND OF THE INVENTION

1. Field of the Invention

The present invention relates to a shielding shell, and more particularly to a shielding shell of a connector.

2. The Related Art

With the development of electronic technology, a connector is required to miniaturized more and more, so a shielding shell of the connector is accordingly required to be miniaturized. A conventional shielding shell includes an upper shell and a lower shell mated with each other for receiving an insulating body of the connector therebetween. However, a front of each side board of the lower shell is usually made up by two layers of boards that makes the side board thicker at front than at rear. As a result, the distance between the two side boards is narrower at front than at rear that further makes an inner space of the lower shell smaller. So the miniaturization of the shielding shell is limited and the manufacture craft of the lower shell is complicated.

SUMMARY OF THE INVENTION

It is an object of the present invention to provide a shielding shell adapted for a connector. The shielding shell includes an upper shell and a lower shell. The upper shell has a rear cover engaged in the lower shell, and a front cover connected to a front of the rear cover and mounted beyond the lower shell. The lower shell has a base board, two side boards protruding upward from two opposite sides of a rear of the base board, and a front board protruding upward from a front end of the base board. Two opposite ends of the front board extend sideward to form a pair of fixing boards bent rearward to lie substantially in alignment with the corresponding side boards. Wherein a free end of each of the fixing boards extends to form a fixing portion buckled into a corresponding fixing cavity defined in a front of each of the side boards for fixing the fixing board to the corresponding side board.

As described above, the fixing portion and the corresponding fixing cavity are defined to buckle with each other so as to make the fixing board and the corresponding side board fixed together in alignment with each other that increases an inner space of the lower shell and simplifies a manufacture craft of the lower shell to facilitate the miniaturization of the shielding shell.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
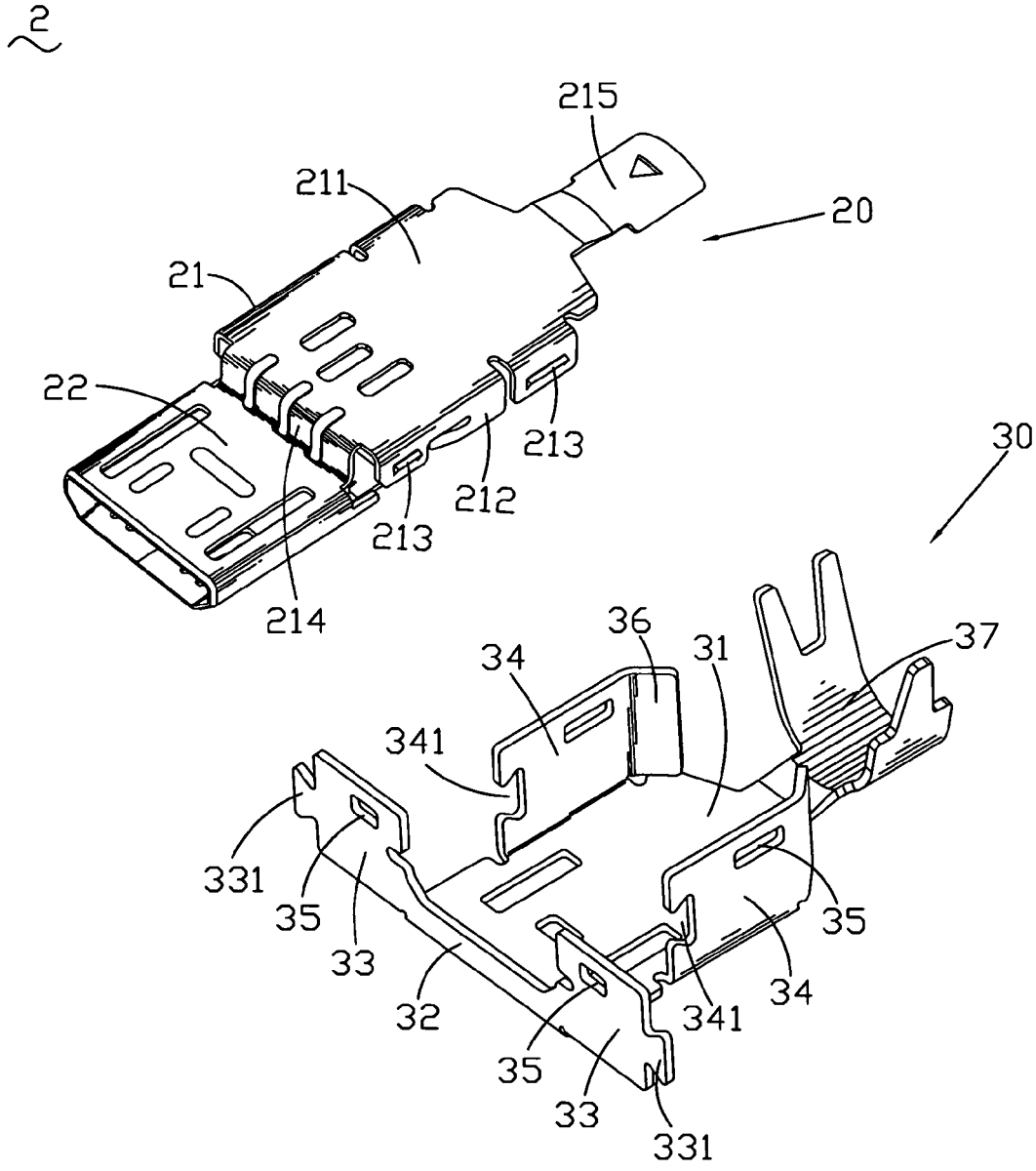
FIG. 1 is an exploded perspective view of a shielding shell of a connector according to the present invention.

Referring to FIG. 1, a shielding shell 2 of a connector according to the present invention includes an upper shell 20 and a lower shell 30 mated with each other for receiving an insulating body (not shown) of the connector therebetween.

The upper shell 20 has a rear cover 21 and a hollow front cover 22 at a front of the rear cover 21. The rear cover 21 has a rectangular top plate 211 disposed levelly. Two opposite sides of the top plate 211 are bent downward to form a pair of side plates 212. Each of the side plates 212 protrudes outward to define two locking blocks 213. A front of the top plate 211 is bent downward to form a connecting plate 214. A rear of the front cover 22 is connected with a bottom of the connecting plate 214. A middle of the top plate 211 extends rearward to form a fastening portion 215.

The lower shell 30 has a rectangular base board 31 disposed levelly. A front of the base board 31 is bent upward to form a front board 32. Two opposite ends of the front board 32 extend sideward to form a pair of fixing boards 33. A middle of a free end of each of the fixing boards 33 protrudes sideward to form a swallow-tailed fixing portion 331. Two opposite sides of a rear of the base board 31 extend upward to form a pair of side boards 34. A middle of a front end of each of the side boards 34 defines a swallow-tailed fixing cavity 341 in accordance with the corresponding fixing portion 331. The side board 34 and the fixing board 33 respectively define a locking hole 35. The side boards 34 extend rearward and inward to form a pair of rear boards 36 apart from each other. A middle of the base board 31 extends rearward to form a retention portion 37.

Figure 2:
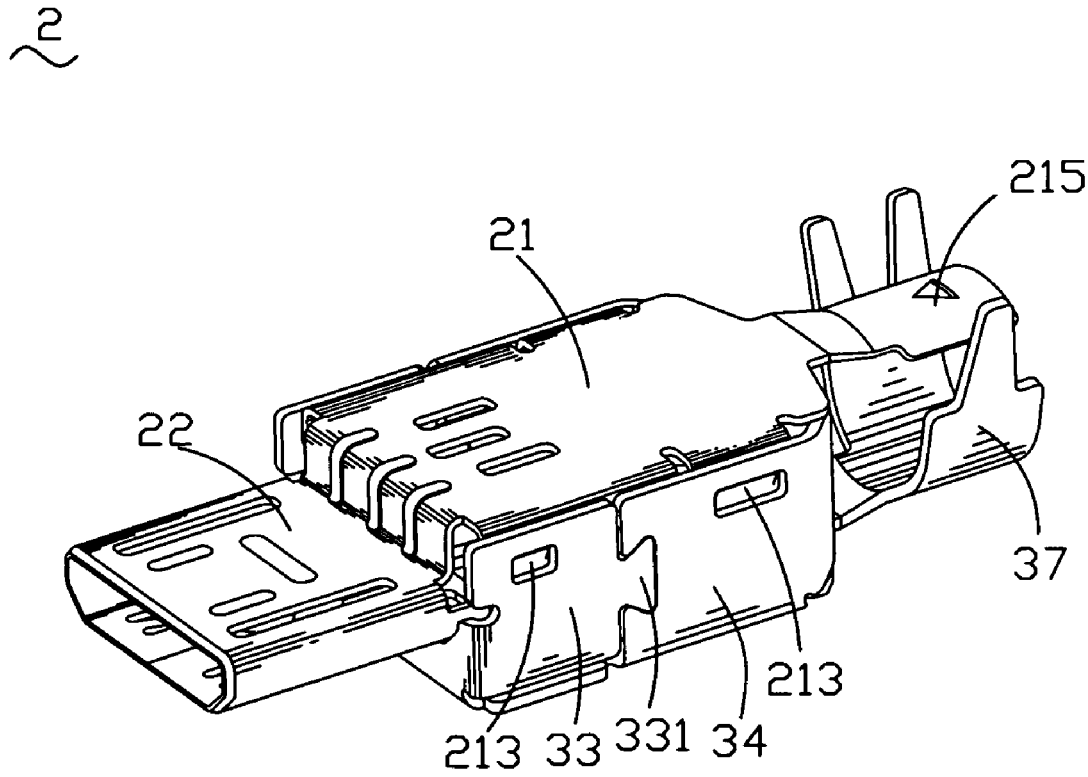
FIG. 2 is a perspective view of the shielding shell of FIG. 1.

Referring to FIG. 2, during assembly, the fixing board 33 is bent rearward to abut against the front end of the corresponding side board 34 and lie in alignment with the corresponding side board 34. The fixing portion 331 is buckled into the corresponding fixing cavity 341 to fix the fixing board 33 to the corresponding side board 34. The rear cover 21 of the upper shell 20 is mated with the lower shell 30 and the front cover 22 of the upper shell 20 stretches out of a front of the lower shell 30. The locking blocks 213 of the upper shell 20 are buckled into the corresponding locking holes 35 of the lower shell 30 to make the lower shell 30 and the upper shell 20 mounted together.

As described above, the fixing portion 331 and the corresponding fixing cavity 341 are defined to buckle with each other so as to make the fixing board 33 and the corresponding side board 34 fixed together in alignment with each other. Therefore, the above-mentioned shielding shell 2 increases an inner space of the lower shell 30 and simplifies a manufacture craft of the lower shell 30 so as to facilitate the miniaturization of the shielding shell 2.

What is claimed is:

1. A shielding shell adapted for a connector, comprising:

an upper shell having a rear cover and a front cover connected to a front of the rear cover; and a lower shell, the rear cover of the upper shell being engaged in the lower shell and the front cover being mounted beyond the lower shell, the lower shell having a base board, two side boards protruding upward from two opposite sides of a rear of the base board, and a front board protruding upward from a front end of the base board, two opposite ends of the front board extending sideward to form a pair of fixing boards bent rearward to lie substantially in alignment with the corresponding side boards, wherein a free end of each of the fixing boards extends to form a fixing portion buckled into a corresponding fixing cavity defined in a front of each of the side boards for fixing the fixing board to the corresponding side board.

2. The shielding shell as claimed in claim 1, wherein the fixing cavity and the fixing portion are swallow-tailed.

3. The shielding shell as claimed in claim 1, wherein the fixing boards and the side boards of the lower shell define a plurality of locking holes, two opposite sides of the rear cover of the upper shell define a plurality of locking blocks buckled into the corresponding locking holes.

* * * * *